US006374410B2

(12) United States Patent
Adamson

(10) Patent No.: US 6,374,410 B2
(45) Date of Patent: Apr. 23, 2002

(54) KNEE PAD FOR FIGURE SKATING

(76) Inventor: Robert Lynn Adamson, 4176 Grove Park La., Boynton Beach, FL (US) 33436

( * ) Notice: Subject to any disclaimer, the term of this patent is extended or adjusted under 35 U.S.C. 154(b) by 0 days.

(21) Appl. No.: 09/808,891

(22) Filed: Mar. 16, 2001

Related U.S. Application Data

(60) Provisional application No. 60/215,315, filed on Jun. 30, 2000.

(51) Int. Cl.[7] ..... A41D 13/00

(52) U.S. Cl. ..... 2/24; 2/465; 602/26

(58) Field of Search ..... 2/455, 465, 16, 2/22, 24, 79, 267, 46, 23, 59, 62, 911, 227; 128/881, 882; 602/1, 6, 23, 25–26, 62

(56) References Cited

U.S. PATENT DOCUMENTS

| | | | | | |
|---|---|---|---|---|---|
| 1,915,753 | A | * | 6/1933 | O'Shea | 2/24 |
| 2,093,888 | A | * | 9/1937 | Holtje | 2/24 |
| 3,170,163 | A | * | 2/1965 | Mitchell | 2/455 |
| 3,322,873 | A | * | 5/1967 | Hitchcock | 264/222 |
| 3,787,892 | A | * | 1/1974 | Quinn | 2/455 |
| 5,105,473 | A | * | 4/1992 | Valtakari | 2/455 |
| 5,134,726 | A | | 8/1992 | Ross | 2/23 |
| 5,170,504 | A | | 12/1992 | Nierhaus | 2/24 |
| 5,255,391 | A | * | 10/1993 | Levine | 2/24 |
| 5,426,786 | A | | 6/1995 | Calvin | 2/2 |
| 5,537,689 | A | | 7/1996 | Dancyger | 2/24 |
| 5,551,082 | A | * | 9/1996 | Stewart et al. | 2/455 |
| 5,717,997 | A | | 2/1998 | Garcia | 2/23 |
| 5,790,981 | A | | 8/1998 | Bzoch | 2/22 |
| 6,058,505 | A | * | 5/2000 | Bettencourt | 2/24 |
| 6,093,468 | A | * | 7/2000 | Toms et al. | 2/22 |
| 6,151,714 | A | | 11/2000 | Pratt | 2/24 |

* cited by examiner

*Primary Examiner*—John J. Calvert
*Assistant Examiner*—Tejash Patel
(74) *Attorney, Agent, or Firm*—Yi Li

(57) ABSTRACT

A knee pad for providing fall protection of a knee is disclosed. The knee pad is a flexible single piece flat pad made of encased resilient polymeric material and is configured to have a top edge portion having a crown for protecting patella of a knee, a pair of first and second side edge portions, and a bottom edge portion. The first side edge portion has an extended flap for protecting a side of the knee. The knee pad can be reversed, front to back, for selectively protecting either medial aspect or lateral aspect of the knee. Furthermore, the knee pad can be held in position by a body tight garment without additional attachment devices. Also disclosed is a multifunctional body protection pad that can be used interchangeably for providing fall protection of a knee or a hip.

20 Claims, 3 Drawing Sheets

KNEE PAD FOR FIGURE SKATING

REFERENCE TO RELATED APPLICATION

This application corresponds in subject matter to Provisional Application Ser. No. 60/215,315, filed Jun. 30, 2000, which is herein incorporated by reference in its entirety.

FIELD OF THE INVENTION

The present invention relates in general to the field of protective knee pads, and more particularly to a flexible, thin, strapless knee pad to provide fall protections of the front and sides of knees, particularly suitable for figure skaters. The present invention also relates to a multifunctional body protection pad that can be used either as a knee pad or a hip pad.

BACKGROUND OF THE INVENTION

Skating, such as figure skating, ice skating, and in-line skating, are popular sports. Among different types of skating, figure skating has additional specific requirements. It requires speed, grace, technique and athleticism to perform an artistic presentation. Jumps are an integral part of a figure skater's performance, as is the aesthetic appearance that they present to the audience.

Unfortunately, skating must contend with various types of falls. These falls are random and essentially expose the skaters' body to 360 degrees potential injury. Knee, hip, elbow and back injuries are common.

Competitive figure skaters practice their technique and jumps many hours every week. During these practices they fall repeatedly. These falls inevitably result in the skater's knees impacting the ice repeatedly and with great force. Injuries to the knee joint and surrounding tissue are en ever-present danger. These injuries range from hematoma to fractures. Various pads have been designed to protect skaters, including knee pads, elbow pads, and hip pads.

All available knee pads are constructed from thick and bulky materials in order to achieve sufficient impact energy absorption for fall protection. These materials, if used in a thinner form, would offer less than adequate protection from injury. The thick and bulky feature is not suitable for the desired aesthetic appearance of skaters, in particular, figure skaters. In addition, available knee pads also requires straps or elastic tubes to attach the knee pads to the legs of a skater. Without straps or other means of attachment, the knee pad will fall because of their thickness, and lack of flexibility. These attachments impose unnatural pressure on a skater's legs, which hinder free movements of the legs, particularly for a long period time of exercise or performance. Moreover, straps and elastic tubes bunch up behind the knee, which further generate unwanted compression, and restrict skater's flexibility that is necessary to perform certain figure skating manoeuvres. Additionally, the straps and elastic tubes also have negative effects on a skater's aesthetic appearance.

Furthermore, most available knee pads provide protection to the front of the knee, but not as much protection to the sides of the knee. However, the medial aspect of the knee, particularly medial epicondyle of femur and the medial condyle of the tibia, or lateral aspect of the knee, particularly the area between the lateral epicondyle of femur and the head of the fibuta, is most often the area that impacts the ice during a fall after a missed jump. U.S. Pat. No. 5,987,643 (to Beutler) discloses a knee pad including side walls to protect the side of the knee. However, the knee pad does not have sufficient extension on the side walls to cover the head of the fibuta, a critical coverage area for figure skaters. In addition, the knee pad depends on straps or other attaching structures to attach the knee pad to a user's leg.

On the other hands, several hip pads have been designed for providing fall protections of a person's hip. U.S. Pat. No. 5,426,786 (to Calvin) discloses a hip pad which can be inserted within the pants of the wearer. The hip pad is a single piece flat pad configured to cover both sides of hips and buttocks area. Although the pad provides protection of hips and buttocks area, it has a large size and would be apparent if it is worn by a figure skater, which would cause undesired distortion of a natural body shape.

U.S. Pat. No. 5,717,997 discloses a form-fitting garment having side pockets that allow hip pads for the protection of the greater trochanter. The hip pads are used with the support of the garment. The garment restricts body flexibility, and the pads also detract from natural body contour aesthetics.

Therefore, it is apparent there exists a special need for a knee pad and a hip pad particularly suitable for figure skating, which would provide fall protections without hindering natural body movements, and meet aesthetic requirements.

SUMMARY OF THE INVENTION

In one embodiment, the present invention provides a knee pad for providing fall protection of a knee. The knee pad comprises a flat single piece of flexible material made of encased resilient polymeric material. The knee pad is configured to have a top edge portion having a crown for protecting patella of a knee, a pair of first and second side edge portions extended from the top edge portion, and a bottom edge portion to which the first and second side edge portions extend. The first side edge portion has an extended flap for protecting a side of the knee.

The knee pad of the present invention is specifically designed to protect patella of the knee, medial or lateral aspect of the knee, particularly the head of fibula and an immediate surrounding tissue. The knee pad can be reversed, front to back, for selectively protecting a desired side of a knee, and further for selectively protecting a knee of a desired leg interchangeably.

The knee pad of the present invention is strapless, and can be held in position by a body tight garment without additional attachment devices.

In a further embodiment, the knee pad of the present invention can also function as a multifunctional body protection pad for providing fall protection of a knee or a hip interchangeably. The multifunctional body protection pad can be used either as a knee pad or as a hip pad at the user's discretion, by inserting the pad in a body tight garment without additional attachment devices.

Moreover, if the multifunctional body protection pad is only used as a hip pad, the thickness of the pad can be increased for providing further protection depending on user's body weight.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

In one embodiment, the present invention provides a flexible, thin, strapless knee pad to provide fall protections of the front and sides of knees. For the purpose of the present invention, a side of a knee denotes either the medial aspect or the lateral aspect of a knee. The medial aspect of a knee includes medial epicondyle of femur, the medial condyle of the tibia, and the immediate surrounding tissue. The lateral of a knee includes the area between the lateral epicondyle of femur and the head of the fibuta, and the immediate surrounding tissue.

Figure 1:
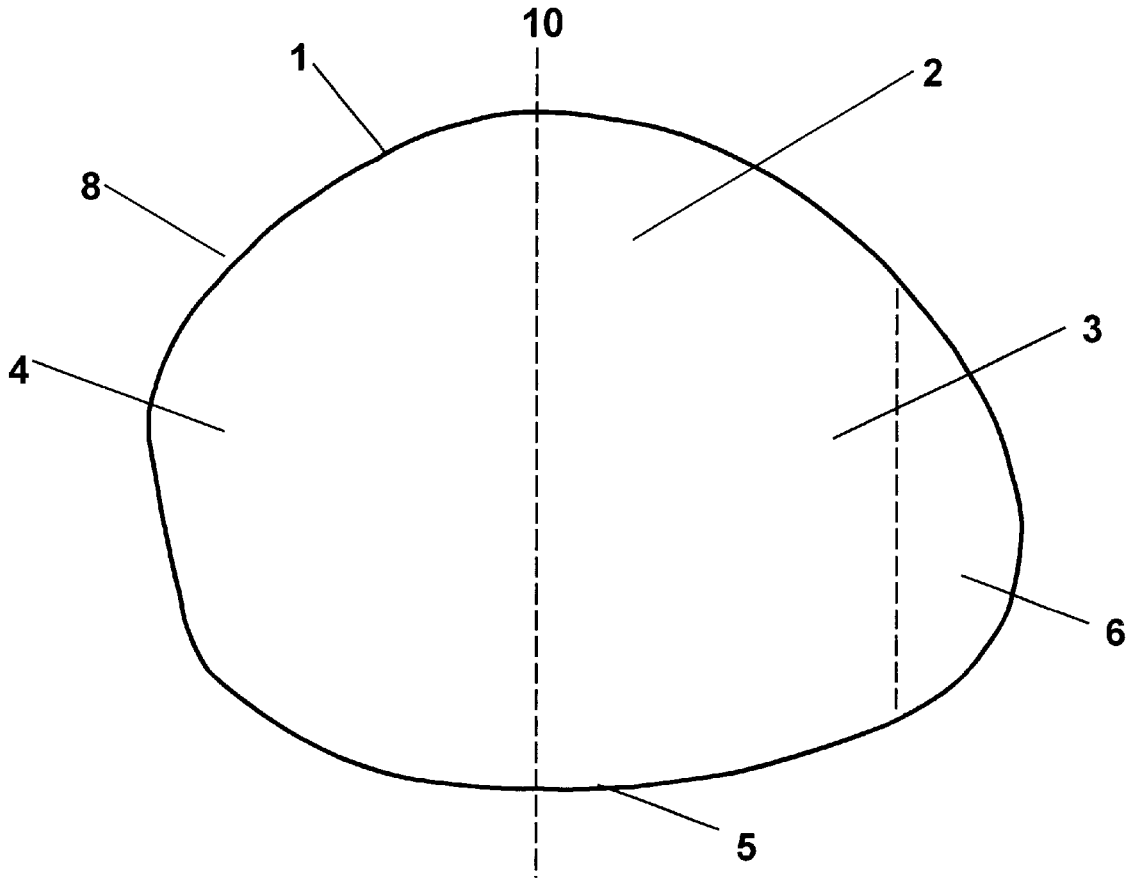
FIG. 1 is a perspective view of the front side of the knee pad in one embodiment of the present invention.

The knee pad comprises a flexible single piece flat pad made of encased resilient polymeric material. As shown in FIG. 1, the knee pad (8) is configured to have a top edge portion (1) having a crown (2) for protecting patella, the kneecap, a first side edge portion (3) and second side edge portion (4) extended from the top edge portion, and a bottom edge portion (5) to which the first and second side edge portions extend. The first side edge portion has an extended flap (6) for protecting a side of said knee. The knee pad is asymmetric. Based on the vertical center line (10) positioned from the highest point of the crown straight down, the ratio of a distance from the vertical center line to the first side edge versus a distance from the vertical center line to the second side edge is greater than 1.0. Preferably, the ratio is in a range from about 1.2 to about 1.5.

The knee pad has a height from the edge of the top edge portion to the edge of the bottom edge portion ranging from about 5 inches to 8 inches. The width of the knee pad ranges from about 7 inches to about 9 inches. The size of the knee pad is designed depending on the user's body size, more particularly, circumference and height of a knee, and to a lesser degree, on total body height and weight. Human knee circumference ranges from about 9.5 to about 18 inches. Optimum coverage of knee circumference is about 75% of the total. Optimum coverage of knee height, from proximal to distal of a leg, is about 5 to 8 inches, which is about 2 to about 3 inches above the patella, and about 3 to about 5 inches below the patella. In general, the larger a person's body, and heavier a person, the larger a knee pad should be used to provide a sufficient protection. However, when a knee pad is too larger, the knee pad carries more weigh, and it would be more difficult to maintain the position with a high degree of body movements. Therefore, the size of a knee pad should be appropriately selected based on the user's size to achieve a proper balance between a sufficient protection and positional stability of the knee pad.

The asymmetrical shape of the knee pad is for the purpose of achieving anatomical symmetry when the knee pad is put in use. The crown (2) of the pad covers and protects the patella and the immediate surrounding tissue from injury. Since the medial aspect and lateral aspect of the knee are most often the area that impact the ice during a fall after a missed jump, the knee pad of the present invention is specifically designed to protect the sides of the knees.

The extended flap (6) of the first side edge portion of the knee pad is designed to cover and protect a side of a knee. When the first side edge portion of the knee pad is placed over the lateral aspect of a knee, the extended flap provides coverage and protection of the head of the fibula and the immediate surrounding tissue, from injury. When the knee pad is reversed, front to back, the first side edge portion provides coverage and protection of medial aspect of the knee, particularly the medial condyles of the femur, and tibia and surrounding tissue, from injury. The knee pad of the present invention is malleable and highly flexible, it wraps over the sides of the knee joint. User may choose either lateral aspect or medial aspect coverage by reversing the knee pad to cover the desired area. The second side edge portion of the knee pad shown in FIG. 1 has a straight edge. However, a curved edge on this side is also suitable for the purpose of the present invention.

The knee pad has a thickness ranging from about 0.12 inch to about 0.40 inch, preferably from about 0.15 inch to about 0.30 inch. This thickness is much thinner than existing knee pads, where multiple layers of fabric and foam materials are typically used to provide impact energy absorption.

The knee pad of the present invention is made of an encased resilient polymeric material known in the art for absorbing and dispersing pressure and impact energy in a thin form (from about 0.12 inch to about 0.30 inch). Suitable examples of the resilient polymeric material include polyurethanes, such as existing commercial products Isogel™ manufactured by Pittsburgh Plastics (Pittsburgh, Pa.) and Akton® polymer manufactured by Action Products, Inc. (22 N. Mulberry Street, Hagerstown, Md. 21704). In the preferred embodiment, Akton® polymer is used. The Akton® polymer is also called viscoelastic polymer, which exhibits very high elasticity and malleableness. The knee pad is constructed by encasing the Akton® polymer in a vinyl envelope to form a flat single piece pad with the configuration described above. The knee pad is latex-free, and has a tissue-like malleableness, and a similar shear characteristics of human skin. The knee pad provides strong impact energy absorption even with a relatively low degree of thickness. The Akton® polymer has following properties:

| Property | Value |
|---|---|
| Rubber Properties in Tension (Peak Tensile) (ASTM D 412-98a) | 18.4 psi |
| Elongation | 1000% |
| Compression Deflection (ASTM D575-91(96) 25% | 0.63 lb/in$^2$ |
| Tear Strength (ASTM D 624-98 Die C Tear) | 3.4 lb/in |
| Resilience Using a Rebound Pendulum (ASTM D 1054-91) | 7.8% |

Figure 2:
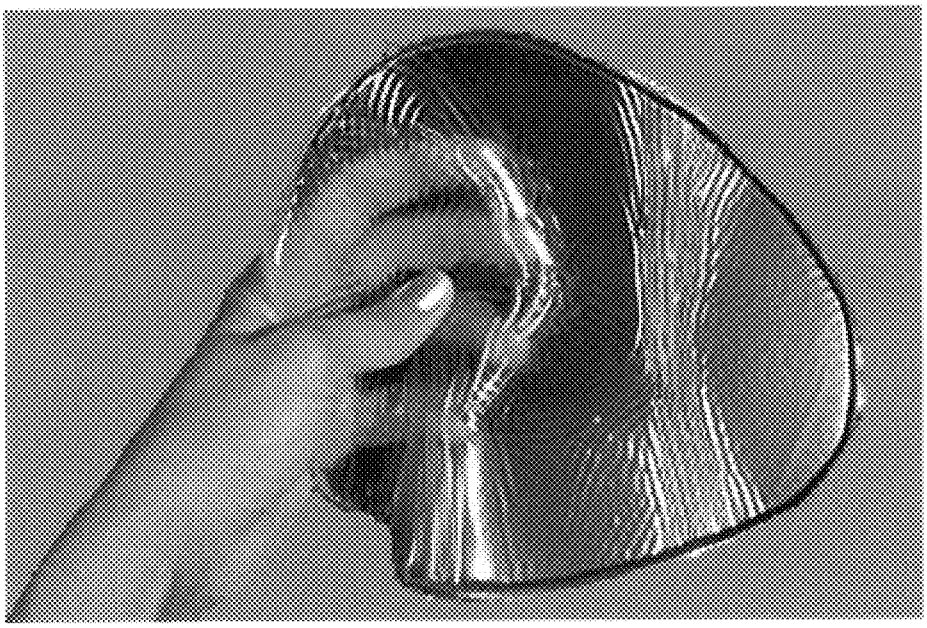
FIG. 2 shows a knee pad of the present invention held by a hand.
Figure 3:
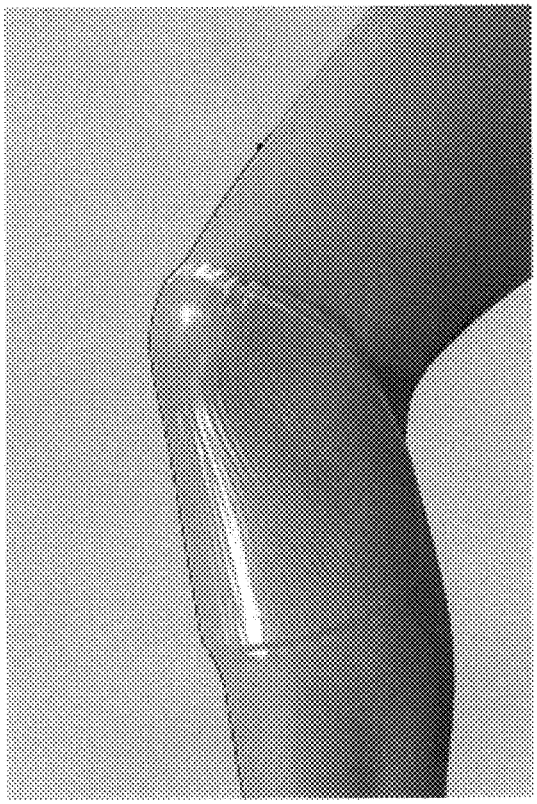
FIG. 3 shows a knee pad of the present invention worn on a skater's leg.

FIG. 2 shows a picture of a knee pad made of Akton® polymer, which shows the highly flexible feature of the knee pad. As illustrated in FIG. 3, the flat single piece knee pad can be wrapped into any shape to completely fit the knee joint. Because of its thinness and flexibility, the knee pads can be directly worn in a pair tights, with contact to the skin, or placed between two pairs of tights commonly worn by the figure skaters. Importantly, the knee pad of the present invention does not require the use of straps, elastic tubes, other commonly used elastic attachment devices, or a pocket further supported by a specially designed garment. It has been found that the knee pads worn in a pair of tights stay in position even with a high degree of body movements during figure skating. Moreover, because of the malleability of the knee pad, it does not impose pressures or restrictions to the knees. In general, the knee pad of the present invention can be worn in a body tight garment without additional attachment devices. The body tight garment includes, but not limited to, leotards, tights, leggings, and tight pants.

Above descriptions are exemplified with figure skaters, however, the utilities and advantages of the knee pad of the present invention to all types of skaters, or people engaged in other sports that also wear tight garments, are apparent. A suitable example of such is bicycle riders who wear body tight garments.

On the other hand, although the knee pad of the present invention does not require additional attachment device to maintain its position under a body tight garment, the knee pad can also be used in conjunction with additional attachment devices. Suitable examples include elastic tubes and pockets with attachment devices. Therefore, as an alternative mode, with additional attachment devices the knee pad of the present invention can also be worn in a manner similar to a conventional knee pad. In this manner, the knee pad of the present invention has a broader scope of utilities. For many sport activities, athletics do not wear body tight garment, but they can still wear the instant knee pad with additional attachment devices. Furthermore, in this manner the knee pad of the present invention can be even thicker, for example, with one half inch of thickness. Importantly, the instant knee pad's thinness, flexibility and its configuration are advantageous for providing knee protection for people involved in various sports. Additionally, it has been found that in conjunction with attachment device the knee pad of the present invention can also be used alternatively as an elbow pad for figure skating and other sports.

Additionally, the knee pad of the present invention also has several other advantages over the existing knee pads. The flat single piece surface of the knee pad is easy to clean with disinfectants, and it does not support microbiological growth. The knee pad does not absorb body fluids or odors, a common problem with fabric containing knee pads. If the knee pad is scratched, punctured, or even having small cuts during a fall or accident, it can easily be repaired by applying an appropriate organic solvent to the out surface, to clean the vinyl covering, and then applying readily available patch material.

Additionally, the surface of the knee pad can be coated with additional materials to further enhance positional stability, which can be beneficial in the situations when the skaters experience with extremely volatile movements. For instance, a thin layer of suitable material with a slightly course surface can be coated on the surface of the knee pad. Further, the surface texture of the knee pad can also be designed to increase surface contact areas, or surface friction with body tight garments. Moreover, a thin layer of adhesive material can also be applied.

In a further embodiment, the present invention provides a multifunctional body protection pad for providing fall protection of a knee and a hip. The knee pad of the present invention described previously can also be used as a hip pad by inserting the pad in a body tight garment without additional attachment devices. For this purpose, the body tight garment has a broader meaning, which does not require a complete leg portion, for instance, biker shorts.

It has been found that the configuration designed for knee protection is also suitable for hip protection. Therefore, the pad is multifunctional, and can be used interchangeably as either a knee pad or a hip at a user's discretion. Apparently, many features and advantages discussed in regards to the knee pad also apply for its application as a hip pad, such as flexibility, malleableness, thinness, use without attachment devices, and ease to clean, etc.

Figure 4:
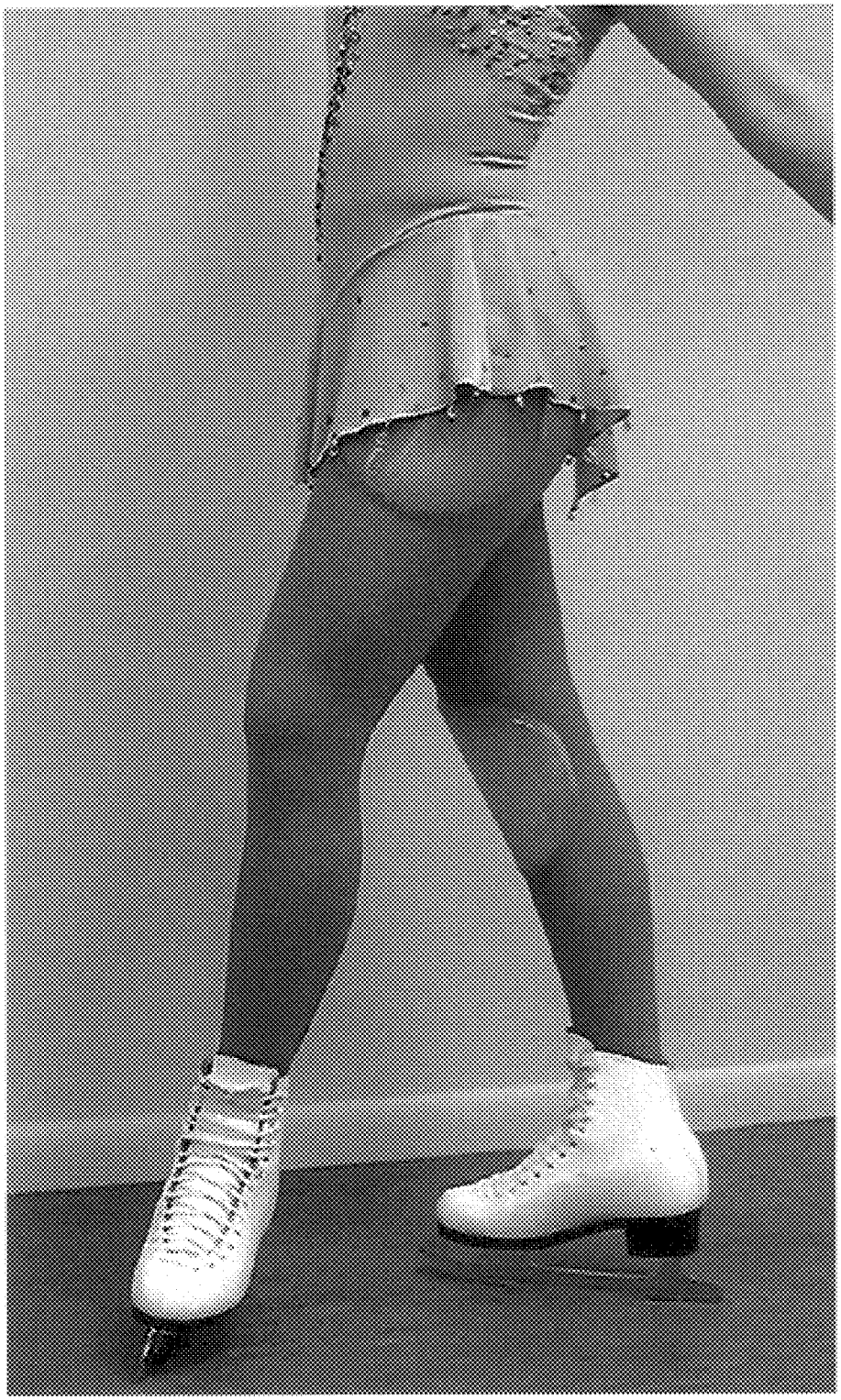
FIG. 4 shows a figure skater wearing two pieces of the multifunctional body protection pad of one embodiment of the present invention over one hip and one knee area.

FIG. 4 shows a figure skater wearing two pieces of the multifunctional body protection pad of the present invention, one over a hip area and one over a knee joint. As shown, the aesthetic appearance of the figure skater is preserved. Use either for knee or hip protection, the multifunctional body protection pad achieves a fine balance between providing a sufficient fall protection and preserving aesthetic appearance, and natural body function of the user. From this point of view, the present invention presents a breakthrough to the fall protection devices for figure skaters.

As illustrated above, the multifunctional body protection pad can be used interchangeably for providing knee or hip protection. If the pad is only used as a hip pad, the thickness of the pad can be increased for providing further protection depending on user's body weight.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

I claim:

1. A knee pad for providing fall protection of the knee comprising a flat single piece of flexible material made of encased resilient polymeric material, wherein said knee pad is configured to have a top edge portion having a crown for protecting patella of the knee, a pair of first and second side edge portions extended from said top edge portion, and a bottom edge portion to which said first and second side edge portions extend, said first side edge portion having an extended flap for protecting a side of said knee, wherein a vertical center line of said knee pad is positioned from a highest point of said crown straight down, a ratio of a distance from said vertical center line to said first side edge versus a distance from said vertical center line to said second side edge is greater than 1.0.

2. The knee pad of claim 1 having a thickness ranging from about 0.12 inch to about 0.40 inch.

3. The knee pad of claim 1 having a height from an edge of said top edge portion to an edge of said bottom edge portion ranging from about 5 inches to 8 inches.

4. The knee pad of claim 1 having a width ranging from about 7 inches to about 9 inches.

5. The knee pad of claim 1, wherein said side of said knee include medial aspect of said knee and lateral aspect of said knee, said medial aspect of said knee including medial epicondyle of femur, the medial condyle of the tibia, and the immediate surrounding tissue; said lateral aspect of said knee including the area between the lateral epicondyle of femur and the head of the fibuta, and the immediate surrounding tissue.

6. The knee pad of claim 5, wherein said knee pad is used reversibly, front to back, for selectively protecting a desired side of said knee.

7. The knee pad of claim 5, wherein said knee pad is used reversibly, front to back, for selectively protecting said knee of one leg and said knee of other leg interchangeably.

8. The knee pad of claim 1, wherein said knee pad is held in position by a body tight garment without additional attachment devices.

9. The knee pad of claim 8, wherein said body tight garment includes leotards, tights, leggings, and tight pants.

10. The knee pad of claim 1 further comprising a layer of a material on a surface of said knee pad, wherein said material enhances attachment between said knee pad, and contacting surfaces of human body and said body tight garment.

11. The knee pad of claim 1, wherein said knee pad can be used in conjunction with additional attachment devices.

12. A multifunctional body protection pad for providing fall protection of the knee and the hip comprising a flat single piece of flexible material made of encased resilient polymeric material, wherein said multifunctional body protection pad is configured to have a top edge portion having a crown for protecting patella of the knee, a pair of first and second side edge portions extended from said top edge portion, and a bottom edge portion to which said first and second side edge portions extend, said first side edge portion having an extended flap for protecting a side of said knee, wherein said multifunctional body protection pad is used as a knee pad and a hip pad interchangeably, by inserting said multifunctional body protection pad in a body tight garment without an additional attachment device selected from the group consisting of strap, and pocket.

13. The multifunctional body protection pad of claim 12 having a thickness ranging from about 0.12 inch to about 0.40 inch.

14. The multifunctional body protection pad of claim 12 having a height from an edge of said top edge portion to an edge of said bottom edge portion ranging from about 5 inches to 8 inches.

15. The multifunctional body protection pad of claim 12 having a width ranging from about 7 inches to 9 inches.

16. A hip pad for providing fall protection of the hip comprising a flat single piece of flexible material made of encased resilient polymeric material, wherein said hip pad is configured to have a top edge portion having a crown, a pair of first and second side edge portions extended from said top edge portion, and a bottom edge portion to which said first and second side edge portions extend, said first side edge portion having an extended flap, wherein a vertical center line of said hip pad is positioned from a highest point of said crown straight down, a ratio of a distance from said vertical center line to said first side edge versus a distance from said vertical center line to said second side edge is greater than 1.0.

17. The hip pad of claim 16 having a height from an edge of said top edge portion to an edge of said bottom edge portion ranging from about 5 inches to 8 inches.

18. The hip pad of claim 16 having a width ranging from about 7 inches to 9 inches.

19. A method of providing fall protection of the knee comprising providing a knee pad comprising a flat single piece of flexible material made of encased resilient polymeric material for inserting said knee pad between two pairs of tights and positioning said knee pad on top of said knee without using an additional attachment device selected from the group consisting of strap, and pocket.

20. A method of providing fall protection of the hip comprising providing a hip pad comprising a flat single piece of flexible material made of encased resilient polymeric material for inserting said hip pad between two pairs of tights and positioning said hip pad on top of said hip without using an additional attachment device selected from the group consisting of strap, and pocket.

* * * * *